US005896600A

United States Patent [19]

Mills et al.

[11] Patent Number: 5,896,600

[45] Date of Patent: Apr. 27, 1999

[54] MOUNTING BRACKET FOR USE ON A TOILET SEAT RING

[76] Inventors: Richard Mills, 221 Haywood, Benbrook, Tex. 76126; John F. Bryan, Jr., 3510 Woodcreek Cir., Parker, Tex. 75002

[21] Appl. No.: 08/806,635

[22] Filed: Feb. 26, 1997

[51] Int. Cl.[6] ..... E03D 9/00

[52] U.S. Cl. ..... 4/661; 4/240

[58] Field of Search ..... 4/234, 236, 237, 4/240, 300.3, 311, 661; 362/191, 802

[56] References Cited

U.S. PATENT DOCUMENTS 2,052,654 9/1936 Ponath ..... 362/191

3,212,104 10/1965 Stevens ..... 4/300.3

3,350,722 11/1967 Moreschini ..... 4/300.3

5,437,066 8/1995 Mills et al. ..... 4/661

*Primary Examiner*—Robert M. Fetsuga

*Attorney, Agent, or Firm*—John F. Bryan

[57] ABSTRACT

A bracket with a central portion and extended end portions, each end portion fitting in a space between the hinge assembly and rear edge of the seat ring on a toilet bowl, for mounting of a light on the central portion, between the hinge assemblies, so that the bracket and the attached light pivot with the seat ring as the seat ring is raised and lowered.

2 Claims, 2 Drawing Sheets

MOUNTING BRACKET FOR USE ON A TOILET SEAT RING

FIELD OF THE INVENTION

The present invention relates to the field of toilet bowl lights and most particularly, to such a light mounted to the toilet seat where it is turned on by raising the seat to a vertical position.

BACKGROUND AND SUMMARY OF THE INVENTION

Night time use of the toilet begs for some degree of illumination, but not so bright as to disrupt the user's night adapted vision. A battery powered light which is turned on to illuminate the toilet bowl interior when the seat is raised is a positive toilet training aid for little boys. The man of the house will appreciate the benefit of a lighted target and moreover, a seat position warning light will also serve for training the positionally insensitive male so that his lady may be spared the annoyance of an unexpected seating position. It is highly desirable to install such a light at the rearmost edge of the toilet seat, as taught by U.S. Pat. No. 5,437,066. This location relative to the seat hinge pivot axis causes the light to be displaced away from exposure to the bowl interior as the seat is lowered, so as to be protected from contamination. Installation of a light in this manner has heretofore required adhesive attachment, which is somewhat difficult in the limited working space at the rear edge of the seat. Inasmuch as the light is battery operated it is also desirable that the assembly be easily removed and reinstalled for battery replacement.

An object of the present invention is therefore, to provide a bracket for mounting a toilet bowl light adapted for easy installation and removal and a second object is to provide this device in simple and inexpensive form.

The present invention accomplishes these objectives by providing a light mounting bracket that supports the light assembly centrally, between the seat hinges at the rearmost edge of a toilet seat ring. Extensions of the bracket drop into place in the spaces between the hinge arms and the seat edge. Mounted thusly, the light assembly moves away from the bowl interior as the seat ring is lowered to its horizontal position and moves forward, while rotating to aim the light into the bowl, when the seat is raised. A gravity actuated switch turns on the light when the seat ring is vertical.

DESCRIPTION OF THE DRAWINGS

The aforementioned and other objects and features of the invention will be apparent from the following detailed description of specific embodiments thereof, when read in conjunction with the accompanying drawings, in which.

DETAILED DESCRIPTION OF THE DRAWINGS

Figure 1:
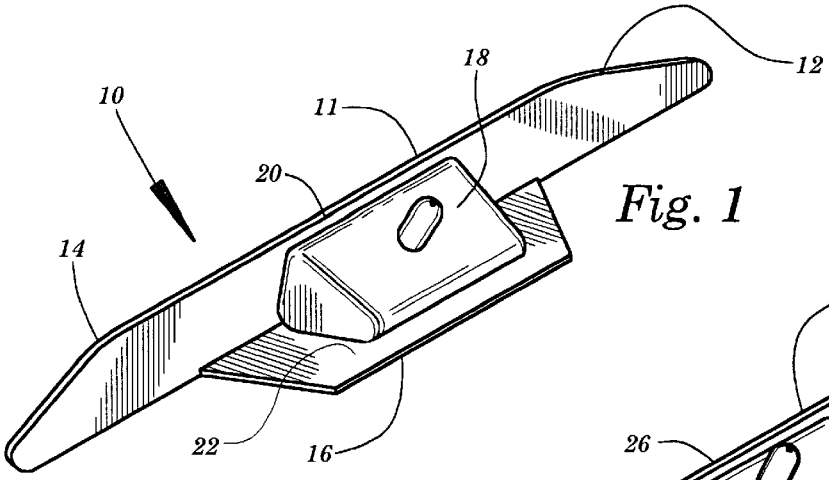
FIG. 1 is a view of a preferred embodiment of the present invention.
Figure 2:
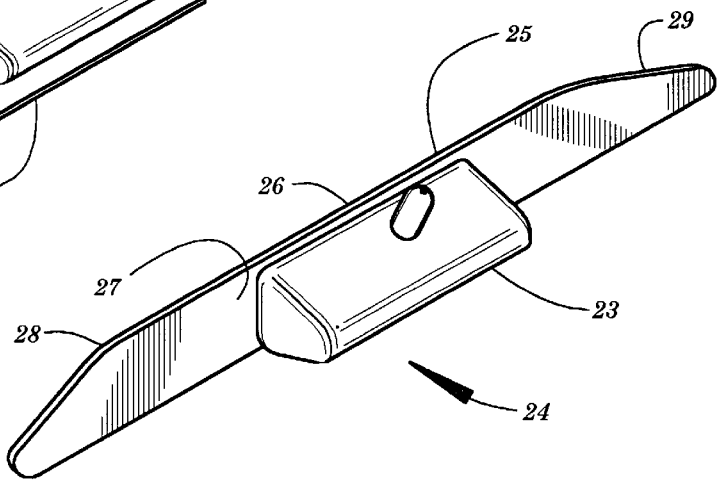
FIG. 2 is a view of a second embodiment of the present invention.

FIG. 1 shows preferred embodiment 10 of the present invention. Here, bracket 11, made of plastic or metal sheet material, is formed to provide a central flange 16, set at approximately 90° to main portion 20, which has extended ends 12 and 14. Light assembly 18 is attached to bracket 11 on inner face 22 of central flange 16, proximate main portion 20, by VELCRO or other adhesive means as discussed below. An alternate embodiment 24, comprising bracket 25 and light assembly 23, seen in FIG. 2, differs primarily in the absence of central flange 16. Light assembly 23 is attached to surface 27 of main portion 26 in the same manner as the attachment of light 18 to surface 22 in FIG. 1, the cross sectional shape of light assembly 23 being conformed for the 90° difference of attachment angle. Extended ends 28 and 29 are essentially the same as the extended ends 12 and 14 of FIG. 1.

Figure 3:
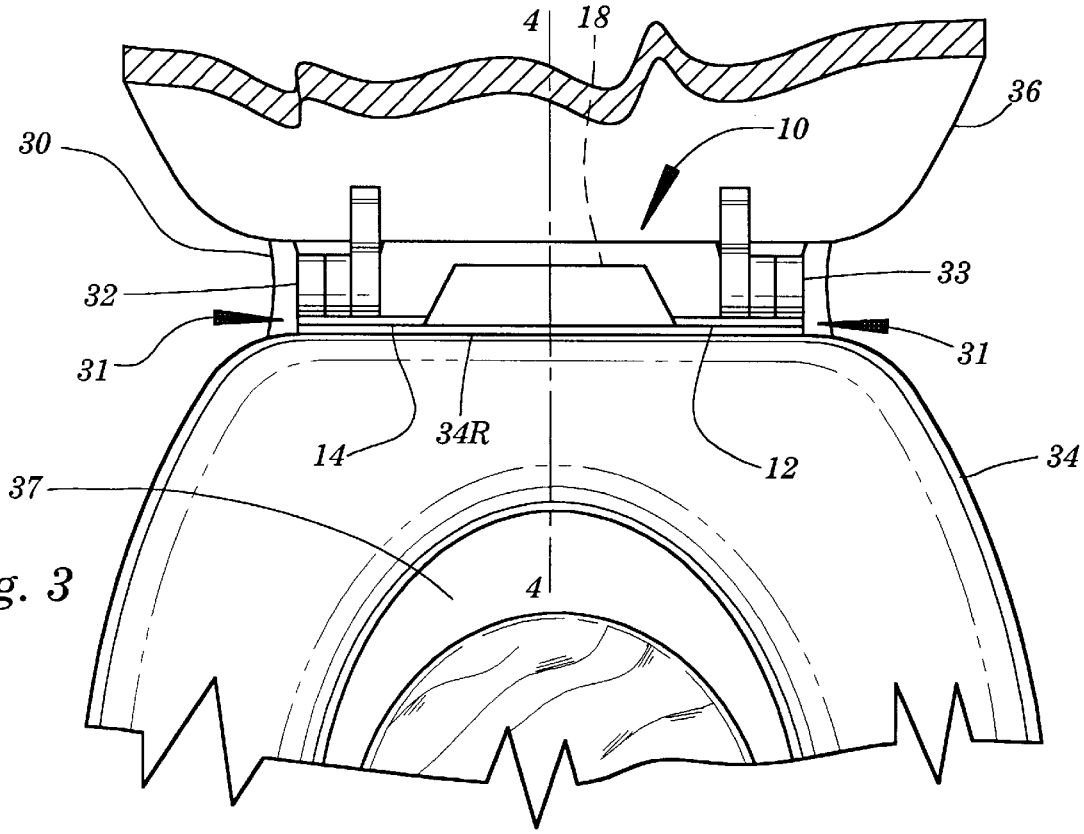
FIG. 3 shows a plan view of the embodiment of FIG. 1 as it appears when installed on a toilet seat ring.

In FIG. 3 is shown the most common type of toilet seat 34 and lid 36, with spaced apart hinge assemblies 32 and 33 providing pivotal attachment to toilet 30. This type of seat is used for 80% or more of all residential toilets. Seat 34 is shown to be in the down, or horizontal position, with lid 36 in the raised position. Space 31, between hinge assemblies 32 & 33 and seat rear edge 34R, allows installation of preferred embodiment 10 to be accomplished by fitting extended ends 12 and 14 therein. Light assembly 18 is thus suspended between spaced apart hinge assemblies 32 and 33 for illumination of toilet bowl interior 37.

In the above manner, preferred embodiment 10 of the present invention may be easily installed on the vast majority of residential toilet seats and is readily removed for cleaning or battery replacement.

Figure 4:
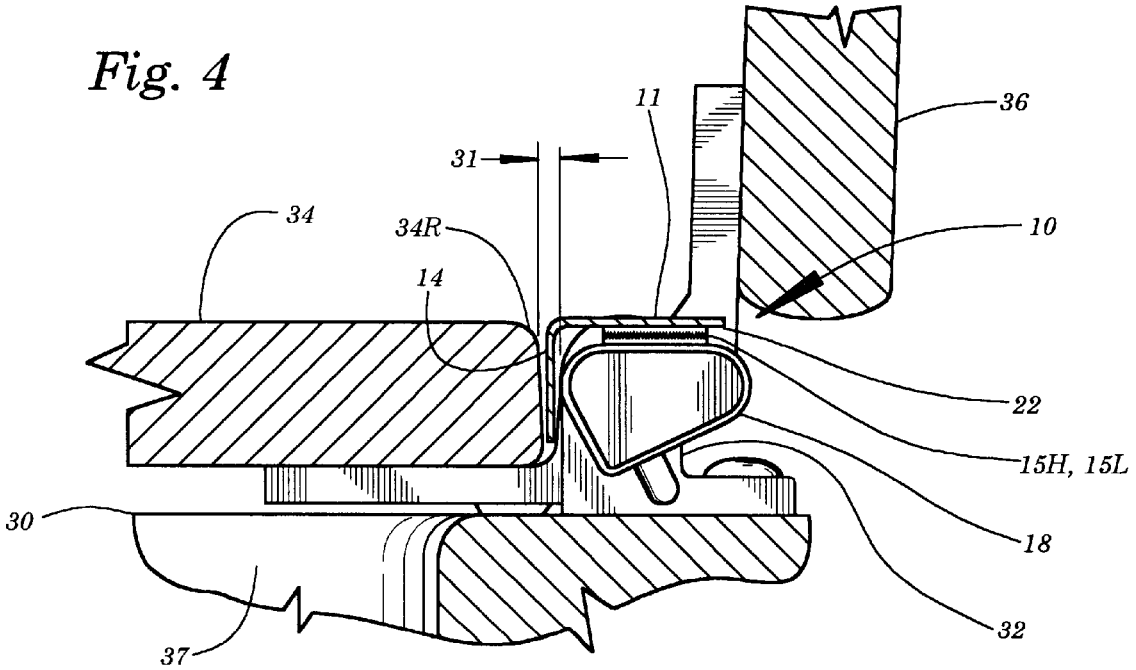
FIG. 4 shows a section view taken along line 4—4 of FIG. 3.

FIG. 4 shows a section view taken along plane 4—4 of FIG. 3. Preferred embodiment 10 is shown with light assembly 18 between spaced apart hinge assemblies 32 and 33 on toilet 30, where hinge assembly 33 is unshown in the view. Extended end 14 of bracket 11 is shown to be fitted into space 31, between hinge assembly 32 and rear surface 34R of seat ring 34. In this view, with seat ring 34 in the down or horizontal position, gravity operated light assembly 18 is turned off and light assembly 18 is displaced so as not to be exposed to toilet bowl interior 37. The attachment of light assembly 18 to surface 22 of bracket 11 is accomplished by hook adhesive tape portion 15H and cooperating loop adhesive tape portion 15L, which parts are adhesively bonded to surface 22 and light assembly 18 respectively. This form of attachment is preferred because it allows separation of the light assembly 18 from bracket 11 for cleaning. While, the toilet seat assembly of FIG. 3 is by far the most common, hook and loop adhesive tape 15H/15L, such as that provided by VELCRO, also provides for installation and removal of light assembly 18 on other toilet seats with molded-in or integral hinges, where bracket 11 cannot be used.

Figure 5:
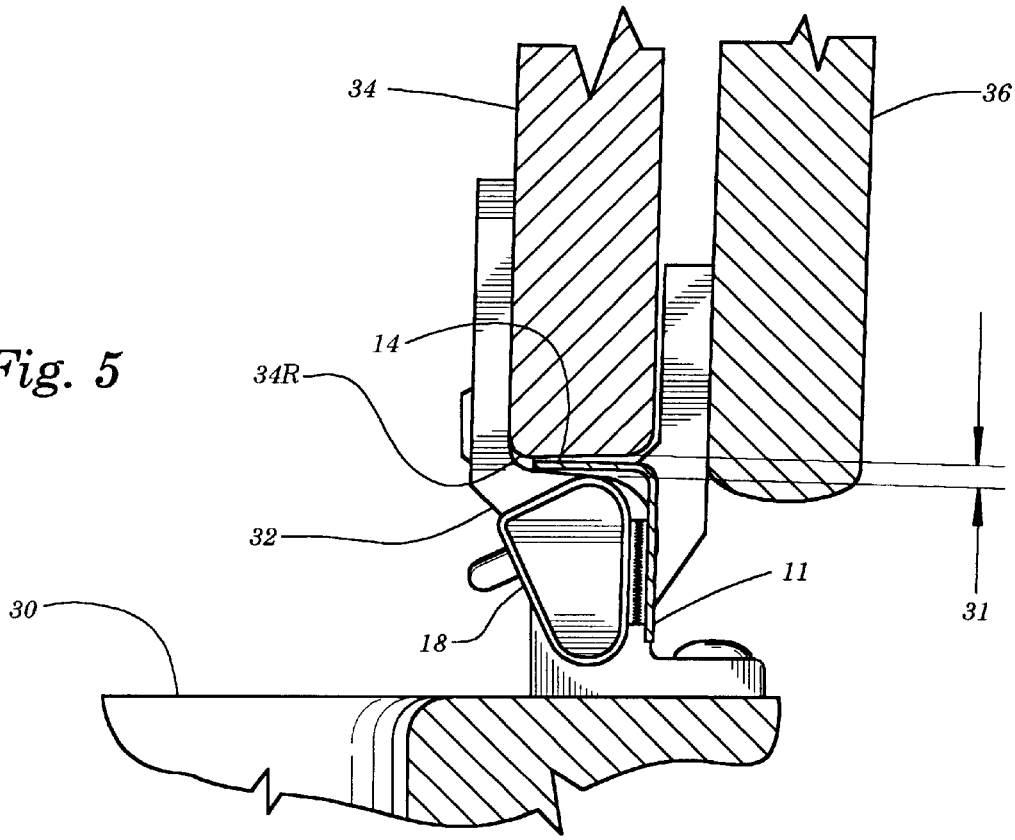
FIG. 5 shows a section view of the installation of FIG. 3 as it would appear with the toilet seat ring in the raised position.

FIG. 5 shows a section view similar to that of FIG. 4, except that seat 34 is shown to be in the raised position wherein gravity operated light assembly 18 is turned on. Note again, that bracket 11 is held in place only by the fit of extended ends 14 and 12 in space 31, between hinge assemblies 32 & 33 and rear surface 34R of seat ring 34. Raising seat ring 34 has also rotated bracket 11 into position for illumination of toilet bowl interior 37 by light assembly 18.

It is to be understood that the present invention is not limited to the disclosed embodiments and may be expressed by rearrangement or modification or substitution of parts, within the same spirit of invention.

I claim:

1. In a toilet bowl illuminating apparatus of the type wherein a seat ring is pivotally mounted to a toilet bowl by a pair of spaced apart hinge assemblies, each hinge assembly providing a narrow space between itself and the toilet seat ring, and in which a light assembly is affixed to the edge of the seat ring, in the area between the spaced apart hinge assemblies, the light assembly being activated to illuminate the toilet bowl interior when the seat ring is pivoted to a raised position and deactivated when the seat ring is pivoted to a lowered postion, the improvement comprising:

a mounting bracket having a central portion to which the light assembly is affixed, rather than to the edge of the seat ring, the central portion having a longitudinal axis; and two end portions extending oppositely from the central portion and along the longitudinal axis, each of the end portions being fitted in the narrow space between the toilet seat ring and one of the hinge assemblies so that the mounting bracket supports the light assembly to rotate about the longitudinal axis when the toilet seat ring rotates on the pivotal mounting thereof.

2. Apparatus according to claim 1 wherein said central portion includes a longitudinally oriented flanged portion.

* * * * *